US006609699B2

(12) United States Patent
Chen

(10) Patent No.: US 6,609,699 B2
(45) Date of Patent: Aug. 26, 2003

(54) OIL DRAIN VALVE

(76) Inventor: Ching-Da Chen, 11F-3, No. 267, Sec. 2, Ta-Tung Rd., Hsi-Chih, Taipei Hsien (TW)

( * ) Notice: Subject to any disclaimer, the term of this patent is extended or adjusted under 35 U.S.C. 154(b) by 0 days.

(21) Appl. No.: 09/988,164

(22) Filed: Nov. 19, 2001

(65) Prior Publication Data

US 2003/0094588 A1 May 22, 2003

(51) Int. Cl.[7] ..... F01M 11/04; F16K 31/44
(52) U.S. Cl. ..... 251/144; 184/1.5
(58) Field of Search ..... 184/1.5; 251/144

(56) References Cited

U.S. PATENT DOCUMENTS 3,677,369 A * 7/1972 Schramm ..... 251/144
4,025,048 A * 5/1977 Tibbitts ..... 251/144
4,231,544 A * 11/1980 Balch ..... 251/144
4,512,547 A * 4/1985 Balch ..... 251/144
4,745,894 A * 5/1988 Laipply et al. ..... 123/196 R
4,807,847 A * 2/1989 Martz ..... 251/144

* cited by examiner

*Primary Examiner*—Paul J. Hirsch
(74) *Attorney, Agent, or Firm*—Troxell Law Office PLLC

(57) ABSTRACT

An oil drain valve comprises a base and a control part. The base is fixedly attached to a drain hole at the bottom of the oil container. The base at the interior is a hollow chamber to communicate with the oil container and a guide opening is provided at the lateral wall of the base to communicate with the hollow chamber. The control part at the interior thereof has a communication chamber communicates with the hollow chamber and the lateral side thereof has an outlet connects with the communication chamber. The base at the lateral wall thereof has a guide groove and receiver grooves with a resilient piece being received in each receiver groove. A ball is disposed on the respective resilient piece to be biased against the guide groove so that the control part can fit with the base pivotally to block the guide opening. As soon as the control part is turned to allow the guide opening in a state of communicating with the outlet, the oil in the oil container can be drained away through the outlet or the guide opening.

6 Claims, 3 Drawing Sheets

OIL DRAIN VALVE

BACKGROUND OF THE INVENTION

1. Field of the Invention

The present invention relates to an oil drain valve, and, particularly, to an oil drain valve with simplified structure and convenient operation with easy assembly.

2. Description of Related Art

Generally, the lubrication oil in an engine of a car or a motorcycle has to be renewed after using a period of time to reduce the engine being worn out and maintaining a smooth running. Currently, the drain hole at bottom of the engine is blocked by way of a screw with a washer, and it is required to disengage the screw and the washer before the oil in the engine being drained away. A new washer and the original screw has to be fastened to the drain hole before the new oil can be filled in. It is known that it is very possible for the screw to become loosening in case of the engagement and the disengagement of the screw being conducted several times and it may result in a phenomenon of oil leakage unless the screw is replaced a new one. Hence, the conventional way to plug the drain hole get involved in the defects such as being necessary to use the tool, taking time to be operated, being required to replace the washer all the time, and being easy to occur the oil leakage.

SUMMARY OF THE INVENTION

An object of the present invention is to provide an oil drain valve, which can be mounted by oneself without the assistance of any tool and the operation of oil drain can be performed easily with time saving.

Another object of the present invention is to provide an oil drain valve, which does not need the washer so that no job required for replacing the washer in case of oil drain.

A Further object of the present invention is to provide an oil drain valve, with which parts thereof are not necessary to be detached during oil drain so that no part thereof will be damaged easily.

BRIEF DESCRIPTION OF THE DRAWINGS

The present invention can be more fully understood by reference to the following description and accompanying drawing, in which.

DETAILED DESCRIPTION OF THE PREFERRED EMBODIMENTS

Figure 2:
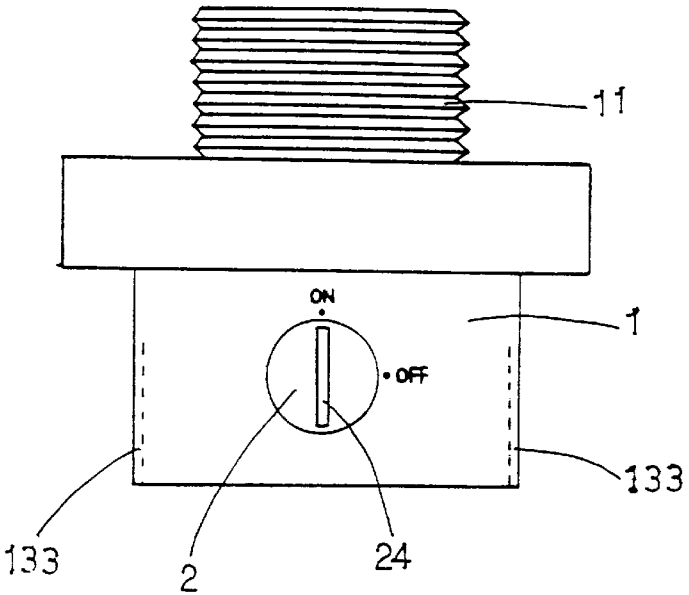
FIG. 2 is a side view of the oil drain valve shown in FIG. 1 after assembling.
Figure 1:
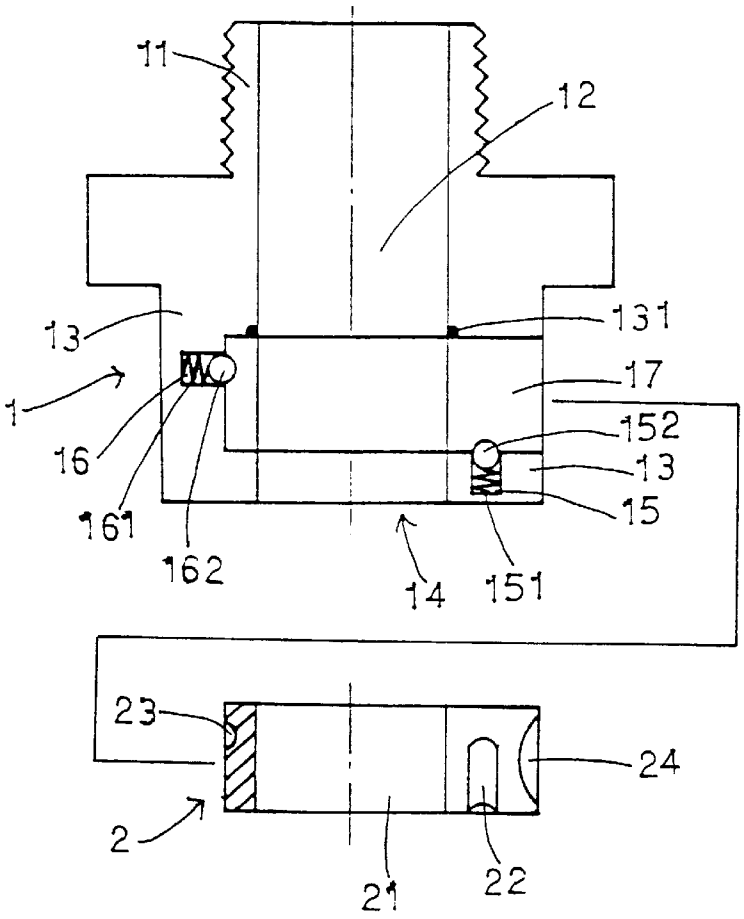
FIG. 1 is an exploded view of an oil drain valve according to the present invention in a first embodiment thereof.

Referring to FIGS. 1 and 2, an oil drain valve of the present invention in a first embodiment thereof comprises a base 1 and a control part 2. The base 1 at the upper end thereof provides a threaded tube section 11 for engaging with the drain hole of an oil container, at the inner side thereof has a hollow chamber 12 to communicate with the threaded tube section 11, and at the bottom thereof provides a guide opening 14. The base 1 at the lateral wall 13 thereof provides a first groove 15, a second groove 16 and an engaging opening 17. A first resilient piece 151 and a second resilient piece 161 are received in the first groove 15 and the second groove 16 respectively, and a first ball 152 and a second ball 162 are disposed on the first groove 15 and the second groove 16 to be pushed up by the first resilient piece 151 and the second resilient piece 161 respectively. An O-ring 131 is arranged at the inner side of the lateral wall 13. The control part 2 is a shaft with an outlet 21 corresponding to the hollow chamber 12 and a guide groove 22 is provided on the control part 2 with two engaging grooves 23. A slit 24 is provided at the front end of the control part 2. The control part 2 is filled in the hollow chamber 12 through the engaging opening 17 of the base 1, and the first and the second balls 152, 162 are pressed against the guide groove 22 and the engaging groove 23 respectively. Once the guide opening 14 communicates with the outlet 21, the oil in the oil container can drain away via the guide opening 14. When the control part 2 is turned to an angular position by way of a coin being inserted into the slit 24 on the control part 2 and the guide opening 14 becomes in a state of not communicating with the outlet 21, the guide opening 14 is blocked by the control part 2 and the oil will not drain away from the guide opening 14. The O-ring 131 can offer a function of further airtight between the base 1 and the control part 2 so that the drain valve can be free from oil leakage while the control part 2 is in a state of sealing off the base 1. Furthermore, the control part 2 can be joined to the base 1 firmly due to the first ball 152 pressing against the guide groove 22, and the control part 2 is not possible to rotate automatically under a situation of being swayed due to the second ball 162 pressing against the engaging groove 23 at a position of open or shut. Besides, the lateral wall 13 at the outer side thereof provides two opposite flat openings 133 for the base 1 being turned easily.

Figure 4A:
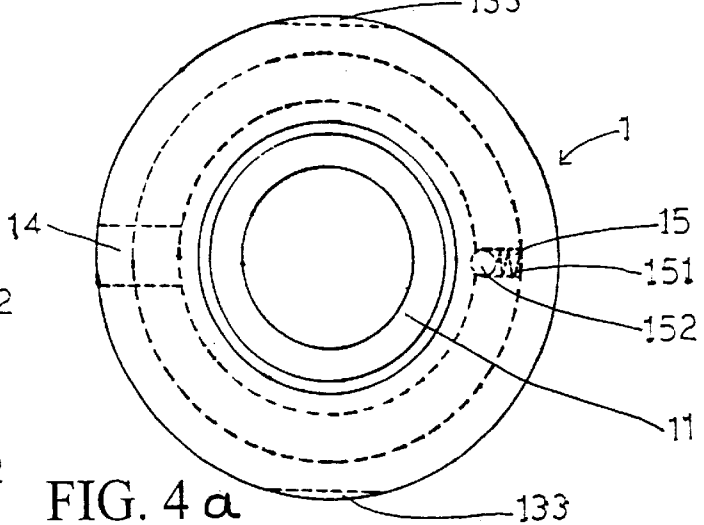
FIG. 4*a* is a top view of the base of the oil drain valve shown in FIG. 3.
Figure 4B:
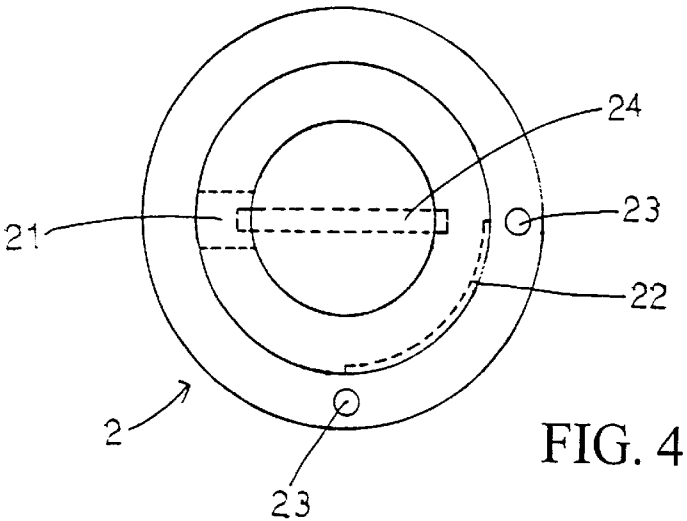
FIG. 4*b* is a top view of the control part of the oil drain valve shown in FIG. 3.
Figure 3:
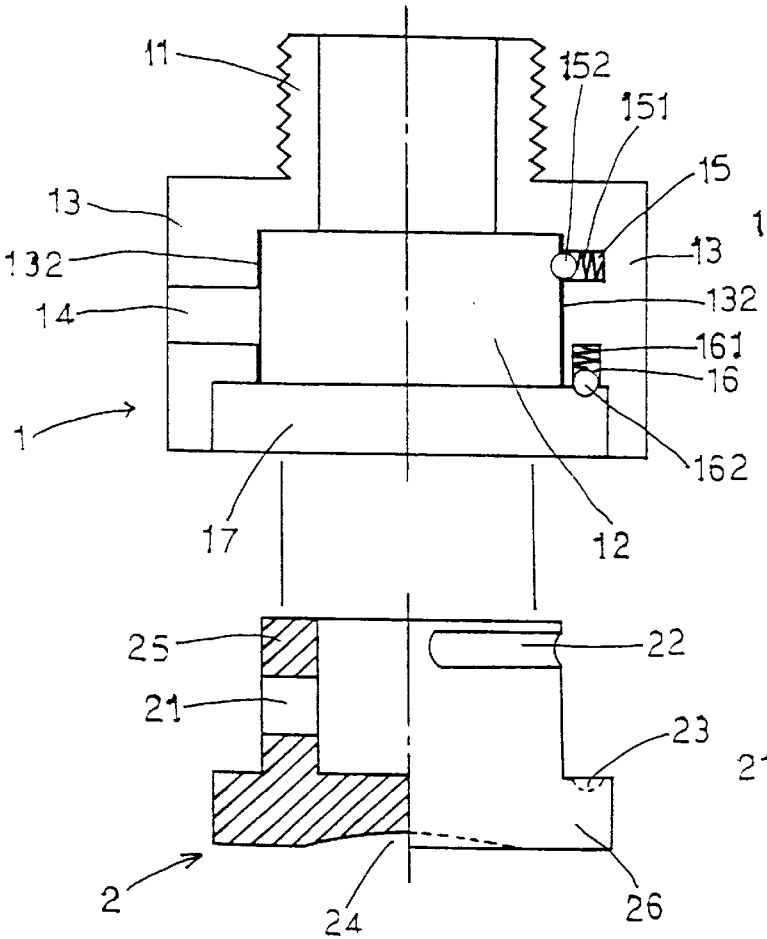
FIG. 3 is an exploded view of an oil drain valve according to the present invention in a second embodiment thereof.

Referring to FIGS. 3 and 4, a second embodiment of the present invention is illustrated and it is noted that parts identical with or similar to those in the first embodiment are designated with the same reference numbers. The oil drain valve in the second embodiment comprises a base 1 and control part 2. The base 1 at the upper end thereof provides a threaded tube section 11 to engage with the inner side of the drain hole of the oil container and at the interior thereof has a hollow chamber 12 to communicate with the threaded tube section 11. Further, the base 1 at the lateral wall 13 thereof is arranged to have a guide opening 14, a first groove 15 and a second groove 16 respectively, and at the lower end thereof has an engaging opening 17. A first resilient piece 151 and a second resilient piece 161 are received in the first groove 15 and the second groove 16 respectively, and a first ball 152 and a second ball 162 are disposed on the first groove 15 and the second groove 16 to be pushed up by the first resilient piece 151 and the second resilient piece 161 respectively. The lateral wall 13 at the inner side thereof provides a layer of Teflon 132. The control part 2 has a cylinder section 25 and an enlarged lower cover 26. The cylinder section 25 provides an inner communication chamber 251 with an outlet 21 and a guide groove 22 at the wall thereof. The lower cover 26 at the upper edge thereof provides an engaging groove 23 and at the bottom thereof has a slit 24. The cylinder section 25 of the control part 2 is filled in the hollow chamber 12 through the engaging opening 17, and the first and second balls 152, 162 press against the guide groove 22 and the engaging groove 23 respectively. When the guide opening 14 is in a state of communicating with the outlet 21, the oil can drain away via the guide opening 14 of the oil container. When the control part 2 is turned to an angular position by way of a coin being inserted into the slit 24 on the control part 2 and the guide opening 14 becomes in a state of not communicating with the outlet 21, the guide opening 14 is blocked by the cylinder section 25 and the oil will not flow out from the guide opening. The Teflon 132 offers a function of further airtight while the control part 2 is in a state of sealing off the base 1 such that it is possible to prevent the oil in the air container from leakage. Furthermore, the control part 2 can be joined to the base 1 firmly due to the first ball 152 pressing against the guide groove 22, and the control part 2 is unable to rotate automatically under a situation of swaying. Besides, the lateral wall 13 at the outer side thereof provides two opposite flat openings 133 for the base 1 being fastened to the drain hole of the oil container easily.

Figure 6A:
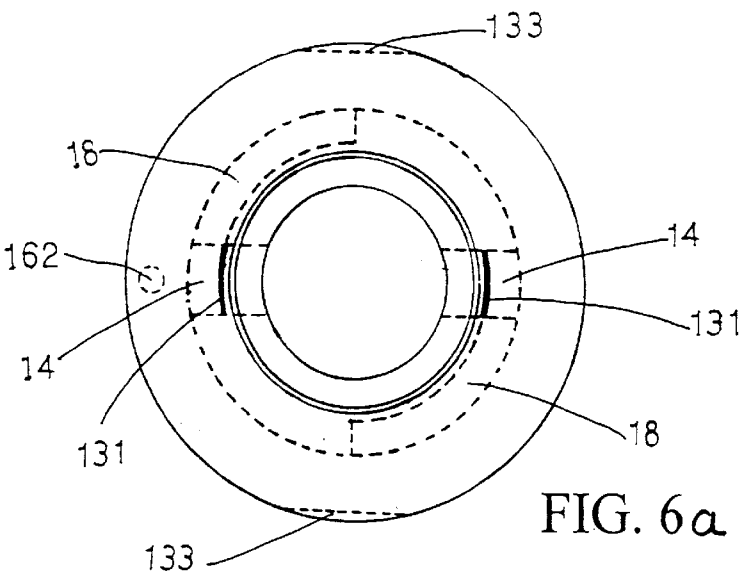
FIG. 6*a* is a top view of the base of the oil drain valve shown in FIG. 5.
Figure 6B:
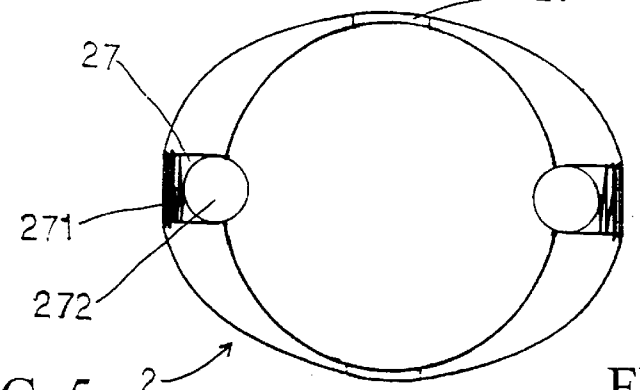
FIG. 6*b* is a top view of the control part of the oil drain valve shown in FIG. 5.
Figure 5:
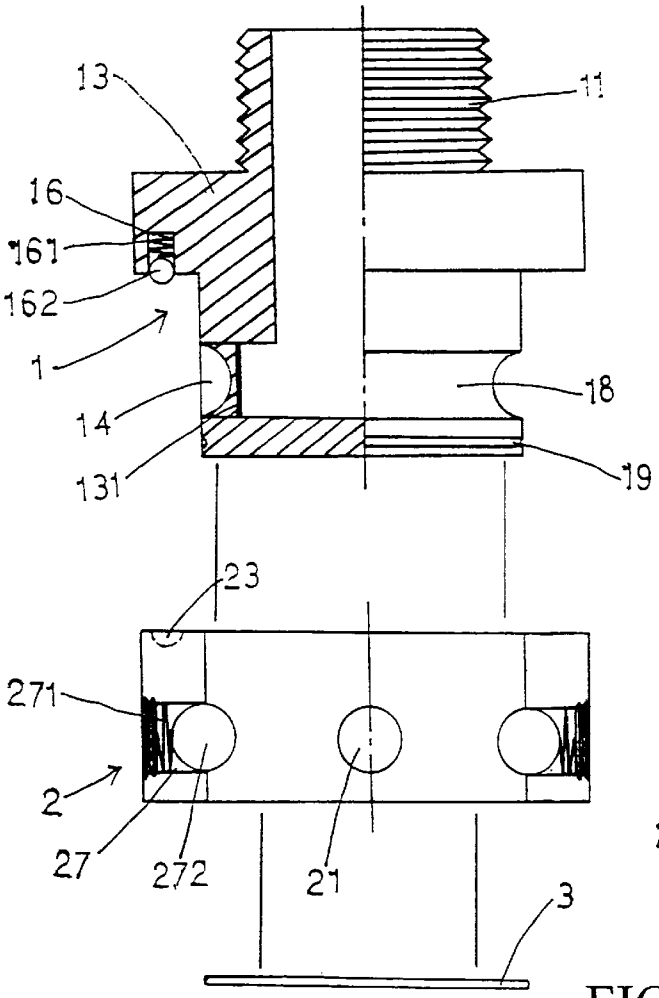
FIG. 5 is an exploded plan view of an oil drain valve according to the present invention in a third embodiment thereof.

Referring to FIGS. 5 and 6, a third embodiment of the present invention is illustrated and it is noted that parts identical with or similar to those in the first and the second embodiments are designated with the same reference numbers. The oil drain valve in the third embodiment of the present invention comprises a base 1, a control part 2 and an E-clip 3. The base 1 at the upper end thereof extends a threaded tube section 11 to engage with the drain hole of an oil container, and at the interior part thereof has a hollow chamber 12 to communicate with the threaded tube 11. Further, the base 1 at the lateral wall 13 thereof is arranged to have a guide opening 14, a first guide groove 18 and a second groove 16, and the lower part of the base 1 has a smaller diameter than the lateral wall 13 and extends downward from the lateral wall 13 with a lower end thereof providing an engaging groove 19. The second groove 16 receives a second resilient piece 161 and a second ball 162 is placed at the opening of the second groove 16 to be pushed up by the second resilient piece 161. The guide opening 14 at the inner side thereof is attached with an O-ring 131. The control part 2 is provided with a shape of ellipse and the inner wall of the control part 2 fits with the outer surface of the lower part on the base 1. Further, the upper edge of the control part 2 provides two engaging grooves 23, and the circumferential wall of the control part 2 has two opposite outlets 21 and two opposite receiver grooves 27 with a resilient piece 271 and a ball 272 in each receiver groove 27. The control part 2 fits with the lower part on the base 1 in a way of surrounding the lower part of the base 1 with the ball 272 and the second ball 162 being biased against the first guide groove 18 and the engaging groove 23 respectively. In case of the guide opening 14 communicating with the outlets 21, the oil in the oil container can drain away though the outlets 21. As soon as the control part 2 is turned an angular displacement to result in the guide opening 14 being not communicating with the outlets 21, the guide opening 14 is blocked by the ball 272 and the oil is unable to flow outward through the guide opening 14. The O-ring 131 offers a function of further airtight while the control part 2 is in a state of sealing off the base 1 such that it is possible to prevent the oil from leakage completely. The control part 2 can join to the lower part of the base 1 by way of the respective ball 272 pressing against the respective first guide groove 18 and the E-clip 3; and it is not possible for the control part 2 to rotate automatically under a situation of swaying by way of the second ball 162 pressing against the engaging groove 23 while the valve is in a state of opening or closing. Further, the respective receiver groove 27 at the bottom wall thereof can be fastened to the circumferential wall of the control part 2 for the respective resilient piece 271 and the respective ball 272 being mounted in place easily.

It is appreciated from the foregoing with regard to the embodiments of the present invention that the base 1 can be fixedly attached to an outlet of an oil trough and the only thing has to be done for draining the oil is to insert a coin in to the slit 24 and turn the control part 2 an angular displacement for the guide opening 14 being in a state of communicating with the outlet 21. Hence, the drain oil valve of the present invention can be operated easily without the need of replacing the washer and is not possible to become damaged after multiple times. Therefore, it is secure that the oil drain valve of the present invention can be free from the oil leakage, which is a frequent phenomenon during the prior art being in use.

While the invention has been described with reference to a preferred embodiments thereof, it is to be understood that modifications or variations may be easily made without departing from the spirit of this invention, which is defined by the appended claims.

What is claimed is:

1. An oil drain valve for attachment to a drain hole of an oil container, comprising a base with an upper end and a lower part, the lower part having a guide opening and a joining surface with two receiver grooves extending inwardly from the joining surface, with a resilient piece and a ball respectively located in each, and a hollow chamber communicating with the drain hole; and a control part including an outlet, and a guide groove and an engaging groove corresponding to the receiver grooves, the guide groove and the engaging groove being pressed by the respective ball biased by the respective resilient piece;

whereby, the upper end of the base is adapted to be joined to the drain hole of the oil container, such that, when the control part is turned to allow the guiding opening to communicate with the outlet, oil in the oil container can be drained.

2. The oil drain valve according to claim 1, wherein the control part is disposed in the hollow chamber and has a slit at a front end thereof.

3. The oil drain valve according to claim 1, wherein the base at a lateral side thereof has an engaging opening communicating with the hollow chamber and wherein the control part is located in the engaging opening.

4. The oil drain valve according to claim 1, wherein the base at a lower end thereof has an engaging opening communicating with the hollow chamber and wherein the control part is located in the engaging opening.

5. An oil drain valve for attachment to a drain hole of an oil container, comprising a base with an upper end and a lower part, the base having a first guide groove and a second guide groove, a first resilient piece and a first ball respectively located in the second guide groove, and a hollow chamber communicating with the drain hole; and a control part including an outlet, two receiver grooves and a second resilient piece and a second ball located in each receiver groove so as to engage the first guide groove wherein the control part is mounted around the lower part of the base;

whereby, the upper end of the base is adapted to be joined to the drain hole of the oil container, such that, when the control part is turned to allow the guiding opening to communicate with the outlet, oil in the oil container can be drained.

6. The oil drain valve according to claim 5, wherein the control part has an elliptical shape and the receiving grooves are disposed adjacent to a lower edge.

* * * * *